US008188831B2

(12) United States Patent
Morishita et al.

(10) Patent No.: US 8,188,831 B2
(45) Date of Patent: May 29, 2012

(54) THERMAL OVERLOAD RELAY

(75) Inventors: Fumihiro Morishita, Konosu (JP); Yukinari Furuhata, Konosu (JP); Takeo Kamosaki, Konosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 221 days.

(21) Appl. No.: 12/656,731

(22) Filed: Feb. 16, 2010

(65) Prior Publication Data

US 2010/0245020 A1 Sep. 30, 2010

(30) Foreign Application Priority Data

Mar. 27, 2009 (JP) ..... 2009-079392

(51) Int. Cl.
*H01H 61/01* (2006.01)
*H01H 37/02* (2006.01)
*H01H 71/16* (2006.01)

(52) U.S. Cl. ..... 337/37; 337/72; 337/36; 337/82; 337/84; 337/85; 337/94; 337/95; 337/129; 337/319; 337/347; 337/357; 337/360; 337/361; 337/368; 337/392; 335/35; 335/45; 335/145; 335/173; 361/93.8; 361/105

(58) Field of Classification Search ..... 337/36, 337/37, 82, 84, 85, 94, 95, 129, 319, 347, 337/357, 360, 361, 368, 392, 72; 361/93.8, 361/105; 335/35, 45, 145, 173
See application file for complete search history.

(56) References Cited

U.S. PATENT DOCUMENTS

| | | | | | |
|---|---|---|---|---|---|
| 2,777,032 | A | * | 1/1957 | Burch | 337/91 |
| 3,015,007 | A | * | 12/1961 | Howard | 337/56 |
| 3,038,051 | A | * | 6/1962 | Howard | 337/62 |
| 3,162,739 | A | * | 12/1964 | Klein et al. | 335/9 |
| 3,183,328 | A | * | 5/1965 | Wheeler | 337/56 |
| 3,214,535 | A | * | 10/1965 | Koenig et al. | 335/37 |
| 3,251,966 | A | * | 5/1966 | Kussy et al. | 337/45 |
| 3,423,712 | A | * | 1/1969 | Howard | 337/77 |
| 3,588,761 | A | * | 6/1971 | Heft et al. | 335/16 |
| 4,536,726 | A | * | 8/1985 | Hideo | 335/23 |
| 4,603,312 | A | * | 7/1986 | Conner | 335/42 |
| 4,625,190 | A | * | 11/1986 | Wafer et al. | 335/20 |
| 4,635,020 | A | * | 1/1987 | Sako | 337/49 |
| 4,636,760 | A | * | 1/1987 | Lee | 335/14 |
| 4,652,847 | A | * | 3/1987 | Sako | 337/49 |

(Continued)

*Primary Examiner* — Anatoly Vortman
(74) *Attorney, Agent, or Firm* — Manabu Kanesaka

(57) ABSTRACT

A thermal overload relay includes a main bimetal for detection of an overload current, a shifter associated with the main bimetal, a release lever working according to a displacement of the shifter, a contact reversing mechanism for changing-over contacts by reversing action caused by rotation of the release lever, and a manipulation structure for manipulating the release lever and the contact reversing mechanism. The manipulation structure includes a reset bar for returning the contact reversing mechanism to an initial state. The reset bar is arranged to change-over between a manual reset state in which the reset bar can be pushed-in and an automatic reset state in which the reset bar is pushed-in and turned from the manual reset state and held in that state.

5 Claims, 15 Drawing Sheets

U.S. PATENT DOCUMENTS 4,763,096 A * 8/1988 Ingrain ..... 337/82
4,785,274 A * 11/1988 Sako et al. ..... 337/49
4,808,961 A * 2/1989 Sako et al. ..... 337/49
4,845,455 A * 7/1989 Sako et al. ..... 337/49
4,912,598 A * 3/1990 Grass ..... 361/652
4,922,220 A * 5/1990 Livesey et al. ..... 337/82
4,983,939 A * 1/1991 Shea et al. ..... 335/42
5,054,754 A * 10/1991 Akiike et al. ..... 267/159
5,767,762 A * 6/1998 Sako ..... 337/348
5,793,026 A * 8/1998 Kolberg et al. ..... 335/172
5,831,501 A * 11/1998 Kolberg et al. ..... 335/42
5,831,509 A * 11/1998 Elms et al. ..... 337/333
5,877,670 A * 3/1999 Sehlhorst et al. ..... 337/302
5,894,259 A * 4/1999 Kolberg et al. ..... 337/333
6,104,273 A * 8/2000 Larranaga et al. ..... 337/82
6,160,470 A * 12/2000 O'Carroll et al. ..... 337/82
6,225,881 B1 * 5/2001 Felden et al. ..... 335/172
6,445,274 B1 * 9/2002 Malingowski et al. ..... 337/49
6,459,355 B1 * 10/2002 Furuhata et al. ..... 337/52
6,496,097 B2 * 12/2002 Frank ..... 337/323
6,507,266 B1 * 1/2003 Bizard et al. ..... 337/349
6,621,403 B2 * 9/2003 Nagahiro et al. ..... 337/75
6,661,329 B1 * 12/2003 Gibson ..... 337/84
6,720,856 B1 * 4/2004 Pellon et al. ..... 337/82
6,816,055 B2 * 11/2004 Weber ..... 337/82
7,135,953 B2 * 11/2006 Leitl et al. ..... 337/84
7,248,140 B2 * 7/2007 Yu ..... 337/94
7,372,356 B2 * 5/2008 Lee ..... 337/360
7,714,692 B2 * 5/2010 Lee ..... 337/84
7,821,376 B2 * 10/2010 Song ..... 337/84
7,868,731 B2 * 1/2011 Furuhata et al. ..... 337/84
2008/0122563 A1 * 5/2008 Song ..... 335/176

* cited by examiner

THERMAL OVERLOAD RELAY

BACKGROUND OF THE INVENTION AND RELATED ART STATEMENT

The present invention relates to a thermal overload relay that performs switching-over of contacts upon detection of an overcurrent, in particular to improvement in manipulation structure for returning to a trip state and an initial state.

Patent Document 1, Japanese Examined Patent Publication No. H7-001665, for example, discloses a thermal overload relay operated by detecting an overcurrent running in the main circuit.

The thermal overload relay of Patent Document 1 is described referring to FIGS. 14 and 15.

As shown in FIG. 14, the thermal overload relay comprises, in an insulator case 1 made of a resin mould, main bimetals 2 inserted in three phase electric circuit and wound with heaters 2*a*, a shifter 3 linked to free ends of the main bimetals 2 and movably supported on the insulator case 1, a switching mechanism 4 disposed in the insulator case 1 allowing linking to an end of the shifter 3, and a contact reversing mechanism 5 to changeover contacts by operation of the switching mechanism 4.

The switching mechanism 4 comprises, as shown in FIG. 15, a temperature compensation bimetal 7 to link to one end of the shifter 3, a release lever 8 to which the other end of the temperature compensation bimetal 7 is fixed, and an adjusting cam 12 connecting to the release lever 8 through a swinging pin 9 projecting at the lower end of the adjusting cam and abutting on the circumferential surface of an eccentric cam 11*a* of an adjusting dial 11 disposed rotatably in the insulator case 1 at the upper end of the adjusting cam 12. A rotation angle of the release lever 8 is set by varying an abutting position of the adjusting cam 12 on the circumferential surface of the eccentric cam 11*a* of the adjusting dial 11 through adjustment of the adjusting dial 11, thereby slightly rotating around a support shaft 13. Thus, the set current is adjusted by setting the rotation angle of the release lever 8.

The contact reversing mechanism 5 comprises a reversing spring 14 fixed at the lower end of the reversing spring to the release lever 8 and extending upwards, a slider 17 linking to the tip of the reversing spring 14 and moving a normally open side movable contact piece 15*b* and a normally closed side movable contact piece 16*a*, and a reset bar 18 to manually move the slider 17 to the normal position. The contact reversing mechanism 5 further comprises the above mentioned normally open side movable contact piece 15*b* and the normally closed side movable contact piece 16*a*, and a normally open side fixed contact piece 15*a* and a normally closed side fixed contact piece 16*b*, the both fixed contact pieces being disposed opposing the movable contact pieces. The reversing spring 14 is a member having a punched window 14*a* formed by punching a thin spring material and a curved surface with a disc spring shape around the punched window 14*a*. The reversing spring 14 is curved with a convex towards right hand side in a normal state shown in FIG. 14.

When the bimetal 2 bends with the heat generated by the heater 2*a* due to an overcurrent in the above-described structure, the shifter 3 shifts to the direction indicated by the arrow P in FIG. 14 caused by displacement of the free ends of the main bimetals 2. The shift of the shifter 3 pushes a free end of the temperature compensation bimetal 7 and rotates the release lever 8 counterclockwise around the swinging pin 9.

With progression of the counterclockwise rotation of the release lever 8, the reversing spring 14 deforms while bending with a convex towards the left hand side. The deformation of the reversing spring 14 moves the slider 17 linked to the tip of the reversing spring 14 so as to turn the normally open side movable contact piece 15*b* and the normally open side fixed contact piece 15*a* into a closed state and to turn the normally closed side movable contact piece 16*a* and the normally closed side fixed contact piece 16*b* into an open state. Based on the information of the closed state of the normally open side movable contact piece 15*b* and the normally open side fixed contact piece 15*a*, and the information of the open state of the normally closed side movable contact piece 16*a* and the normally closed side fixed contact piece 16*b* conducted by the reversing action of the switching mechanism 4, an electromagnetic contactor (not shown in the figures), for example, connected in the main circuit is opened to interrupt the overcurrent.

After the thermal overload relay is turned to a tripped state and an electric current in the electromagnetic contactor is interrupted, the main bimetal 2 cools down and returns to the initial state. If a reset operation is not conducted, the reversing spring 14 does not deform into the opposite direction with a convex towards the right hand side and the slider 17 does not move to the opposite direction holding the contact reversing mechanism 5 in the state unable to return to the initial state.

In order to return the contact reversing mechanism 5 to the initial state, the reset bar 18 is pushed-in to deform the reversing spring 14 in the opposite direction, thereby moving the slider 17 towards the opposite direction.

There are usually two reset states in the returning operation using the reset bar, i.e. a manual reset state and an automatic reset state, the two states being interchangeable. In the manual reset state, the reset bar is pushed in to return the contact reversing mechanism 5 to the initial state. In the automatic reset state, the reset bar is kept in the pushed-in condition and after the main bimetal 2 is cooled down, the contact reversing mechanism 5 automatically returns to the initial state.

If the reset bar 18 readily changes to the automatic reset state, and the electromagnetic contactor is not provided with self-hold circuit, the motor would restart when the main bimetal cools down after halting of the motor due to trip of the thermal overload relay.

In order to cope with this problem, a technology is known in which a projection linked to a head of the reset bar is provided around a case window for passing through the head of the reset bar. When the reset bar is interchanged from a manual reset state to an automatic reset state, the projection is broken and removed.

In the above-mentioned conventional technology, after breaking and removing the projection provided around the case window, the reset bar needs to be manipulated to change from a manual reset state to an automatic reset state. Thus, a complicated manipulation is required for the automatic resetting.

In addition, the reset bar readily interchanges between the manual reset state and the automatic reset state after breaking and removing the projection from the periphery of the case window, thus there is a possibility of wrong operation of the thermal overload relay.

In view of the above-described unsolved problems in the conventional examples, it is an object of the present invention to provide a thermal overload relay that allows interchange of a reset bar between a manual reset state and automatic reset state with a simple operation at multiple desired times, and avoiding wrong operation of the relay.

Further objects and advantages of the invention will be apparent from the following description of the invention.

SUMMARY OF THE INVENTION

In order to accomplish the above object, a thermal overload relay according to the present invention comprises a case; a main bimetal displacing by bending deformation upon detection of an overload current; a release lever working according to displacement of a shifter that displaces following the displacement of the main bimetal; a contact reversing mechanism for changing-over contacts by reversing action caused by rotation of the release lever; and a manipulation structure for manipulating the release lever and the contact reversing mechanism, wherein the all four latter members are disposed in the case. The manipulation structure includes a reset bar for returning the contact reversing mechanism to an initial state, the reset bar partially protruding out of the case and being made to change-over between a manual reset state in which the reset bar is possible to be pushed-in and an automatic reset state in which the reset bar is pushed-in and turned from the manual reset state and held in that state.

The thermal overload relay further comprises a cover attached on the case slidably and capably of covering the manipulation structure, the cover including a reset bar passing window with a configuration of elongated hollow to pass a head of the reset bar and with a longitudinal direction being in the sliding direction of the cover. The reset bar is positioned at one longitudinal end of the reset bar passing window by sliding the cover towards a direction to cover the manipulation structure in the manual reset state and the automatic reset state. The reset bar is held in a. pushed-in state by coupling a bar locking slot formed on an outer circumferential surface of the reset bar and a locking projection formed at the one longitudinal end on the periphery of the reset bar passing window in the automatic reset state.

By the above-stated invention, the operation to change the reset bar to the automatic reset state can be performed only by sliding the cover attached on the case at multiple desired times and the cover holds the reset bar at the pushed-in condition in the automatic reset state. Therefore, any wrong operation is surely avoided in the manual reset state and the automatic reset state.

In the thermal overload relay according to the present invention, the reset bar includes a guiding slot on the circumferential surface thereof at a circumferential position different from the position of the locking slot and the guiding slot of the reset bar couples to the locking projection of the reset bar passing window in a manual reset state and the reset bar is pushed-in with guidance by the guiding slot and the locking projection.

By the above-stated invention, the reset bar is pushed-in smoothly in the manual reset state.

In the thermal overload relay according to the present invention, the manipulation structure comprises an adjusting dial to couple to the release lever for adjusting a setting current, and the cover includes a dial window having a size corresponding to the adjusting part of the adjusting dial; and the dial window faces the adjusting part of the adjusting dial when the reset bar is slid to the other longitudinal end of the reset bar passing window, and the adjusting part of the adjusting dial is covered by the slid cover in the manual reset state and the automatic reset state.

By the above-stated invention, the cover covers the adjusting part of the adjusting dial in the condition the reset bar has been changed to the manual reset state and the automatic reset state, obstructing adjusting operation for a setting current. Therefore, a wrong operation of the thermal overload relay is obviated.

The thermal overload relay according to the present invention further comprises a window for state-indication and manual trip operation, in the vicinity of the reset bar, for manually reversing the contact reversing mechanism and confirming operational state of the contact reversing mechanism, wherein the window for state-indication and manual trip operation is not covered by the cover in the condition of the reset bar slid to the other longitudinal end of the reset bar passing window that is farthest from the coupling projection of the cover, and the window for state-indication and manual trip operation is covered by the cover in the manual reset state and the automatic reset state.

By the above-stated invention, the cover covers the window for state-indication and manual trip operation in the condition the reset bar has been changed to the manual reset state and the automatic reset state, inhibiting a manual trip operation. Therefore, a wrong operation of the thermal overload relay is obviated.

In the thermal overload relay according to the present invention, the cover is formed of a transparent material.

By the above-stated invention, even when some parts of the manipulation structure are covered by the cover, the operation condition of the contact reversing mechanism at that time can be confirmed by visual observation.

A thermal overload relay according to the present invention allows changing operation of the reset bar to an automatic reset state at a desired time only by sliding the cover attached to the case, and holding the reset bar at a pushed-in condition by the cover in the automatic reset state. Therefore, any wrong operation is surely obviated in the manual reset state and the automatic reset state.

BRIEF DESCRIPTION OF THE DRAWINGS

FIG. 6(*b*) is a drawing showing the contact reversing mechanism and a normally open contact (a-contact) that are in a tripped state;

FIG. 7(*b*) is a drawing showing the contact reversing mechanism and a normally closed contact (b-contact) that are in a tripped state;

DETAILED DESCRIPTION OF PREFERRED EMBODIMENTS

Figure 14:
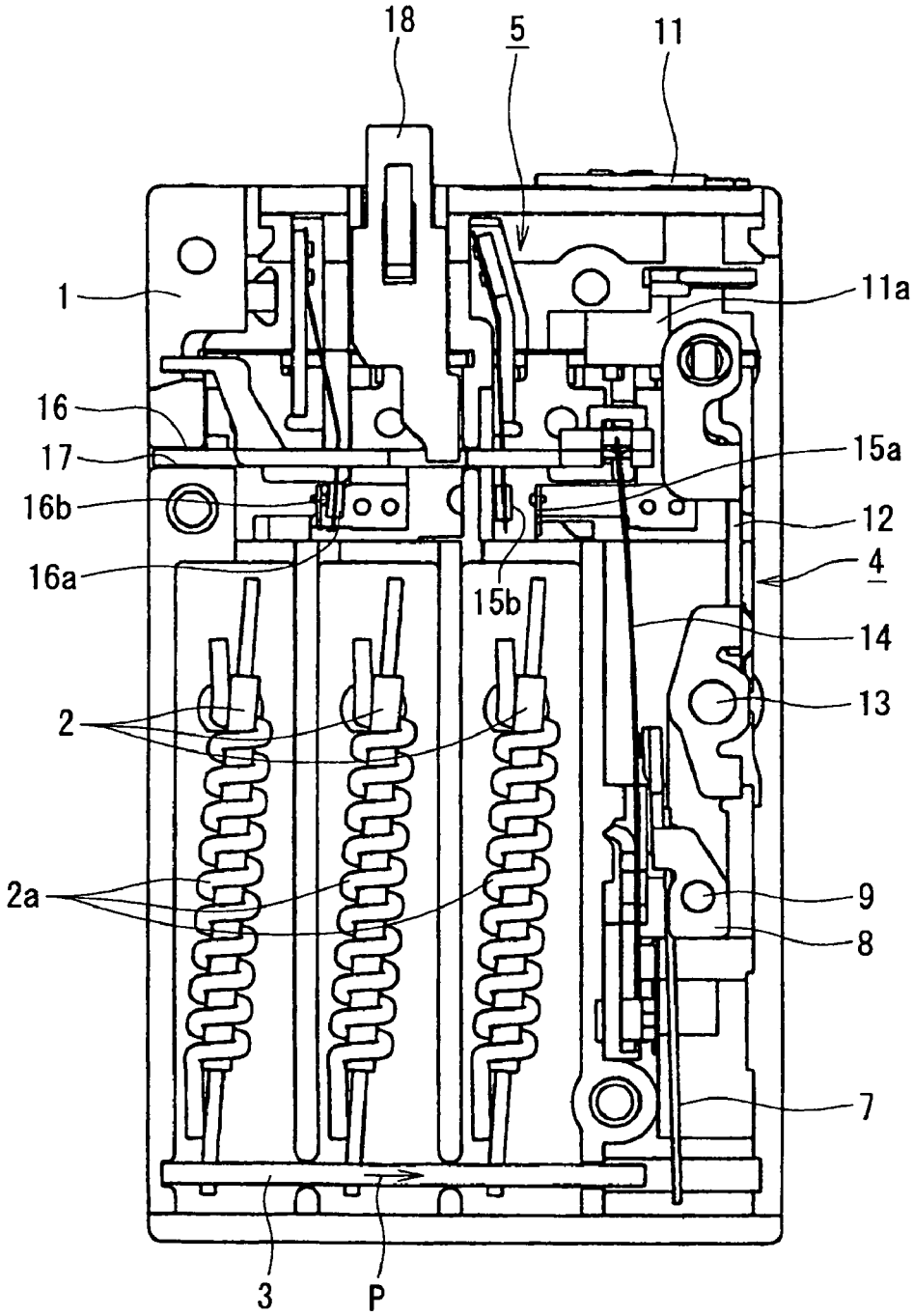
Fig. 14 Prior Art
FIG. 14 is a drawing showing essential parts of a conventional thermal overload relay in an initial state.
Figure 15:
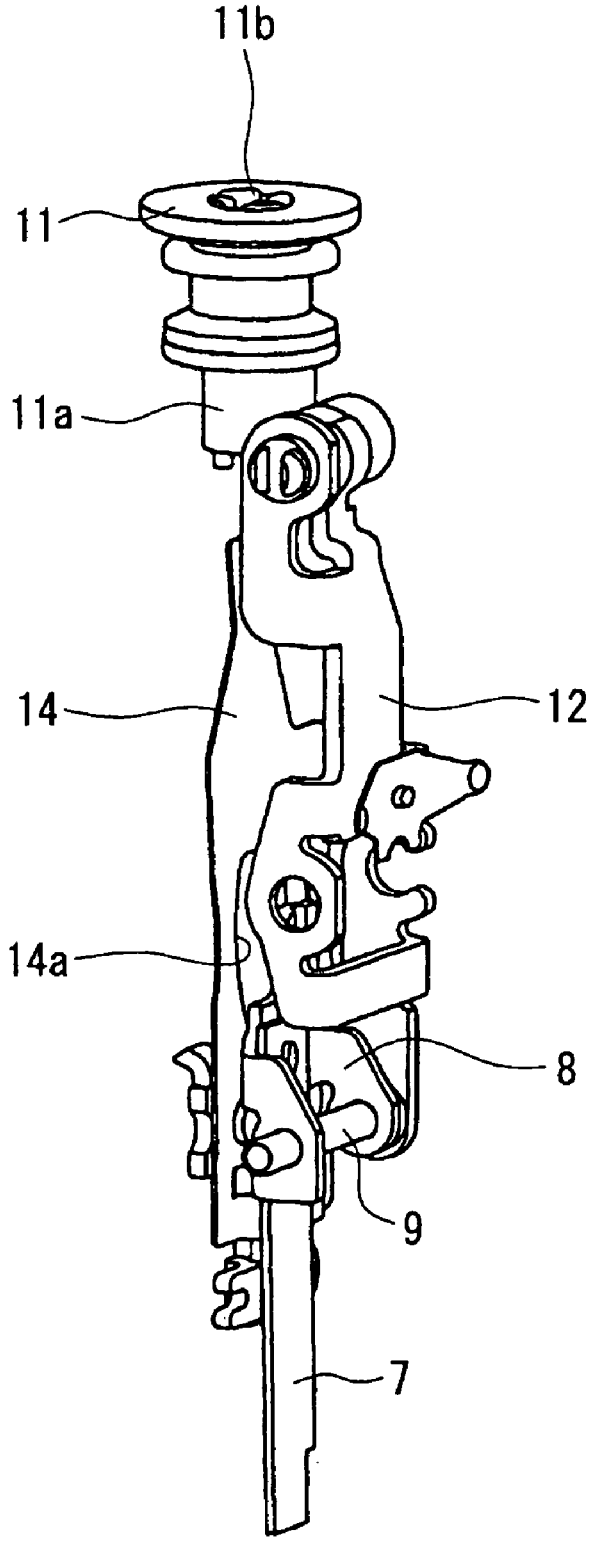
Fig. 15 Prior Art
FIG. 15 is a perspective view of a switching mechanism of the conventional thermal overload relay.

The following describes the best mode of some preferred examples of embodiment according to the invention in detail with reference to the accompanying drawings. The parts of the embodiment examples of the invention similar to the parts in FIG. 14 and FIG. 15 are given the same symbols and their description is omitted.

Figure 1:
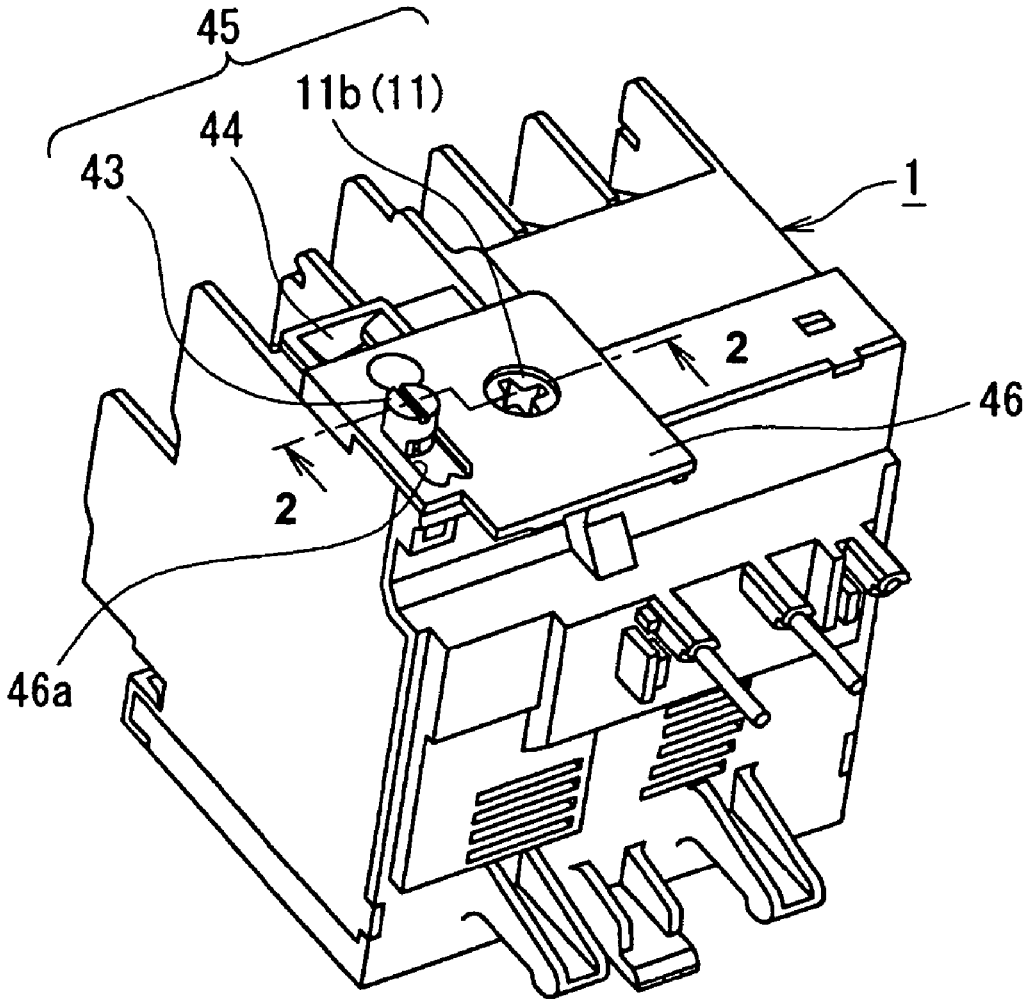
FIG. 1 is an external view of a thermal overload relay according to the present invention.
Figure 2:
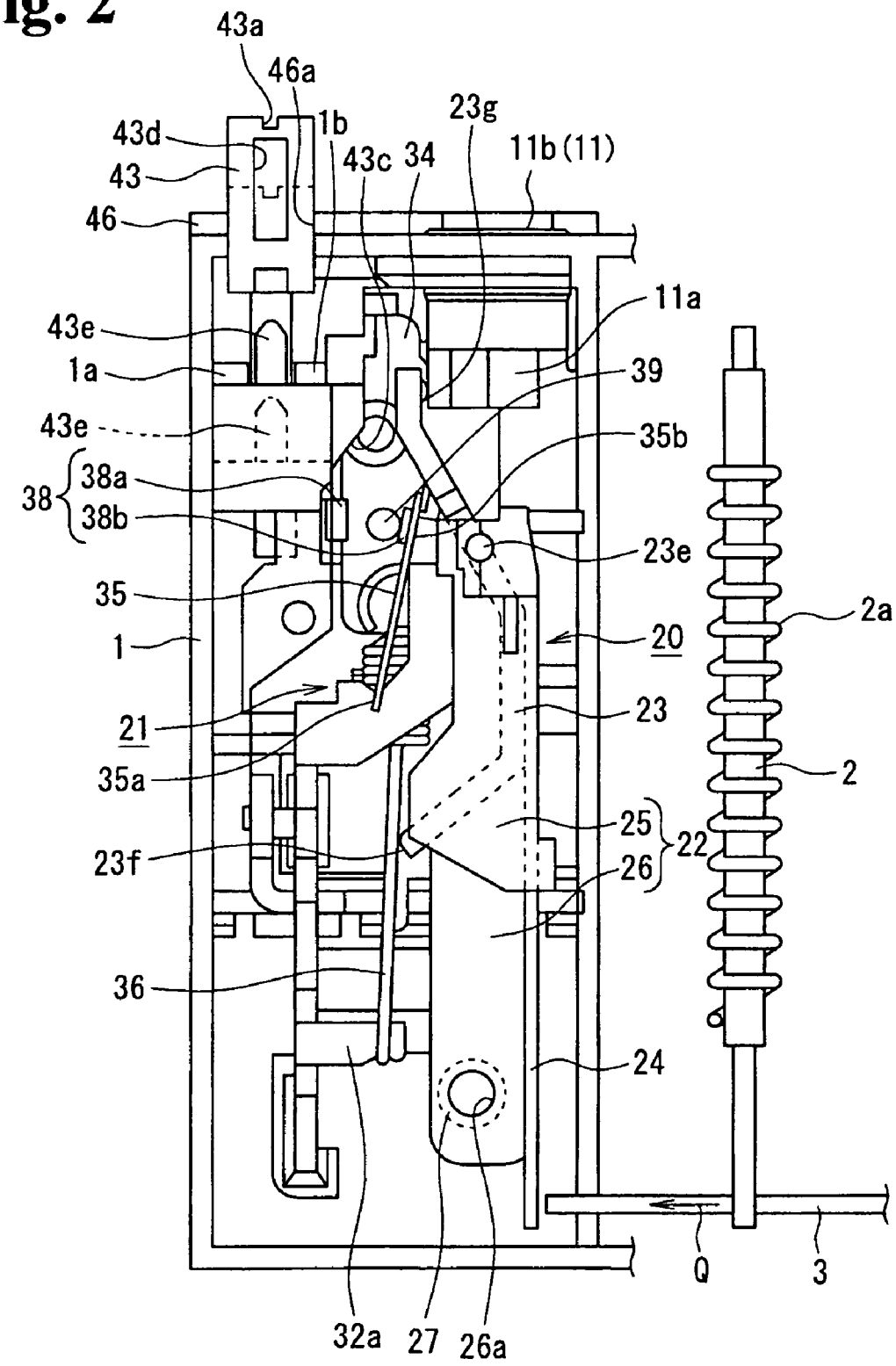
FIG. 2 is a sectional view of an internal structure of the thermal overload relay of FIG. 1 cut along a line 2-2 in FIG. 1.
Figure 3:
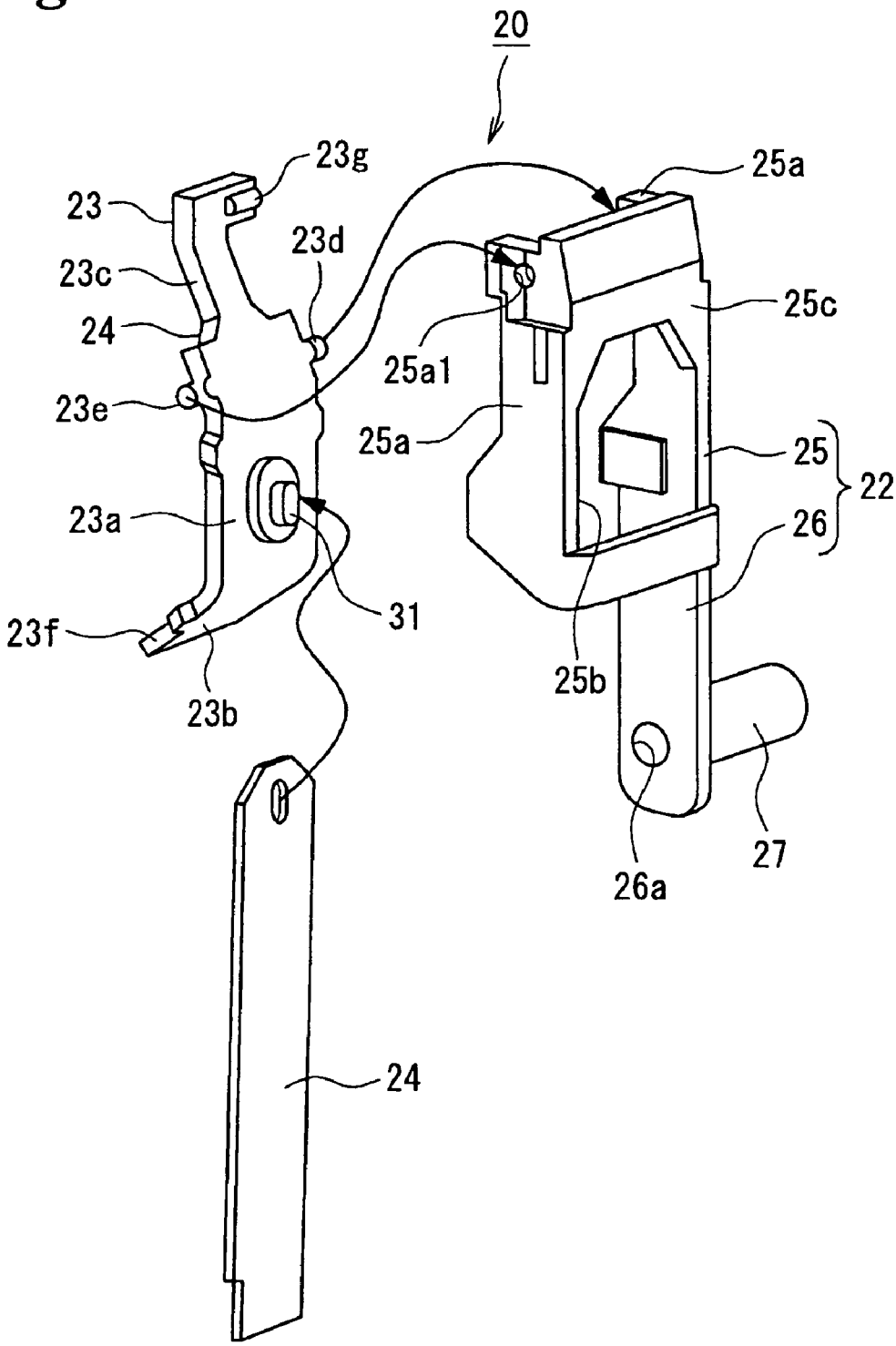
FIG. 3 is an exploded perspective view of an adjusting mechanism of the thermal overload relay.
Figure 4:
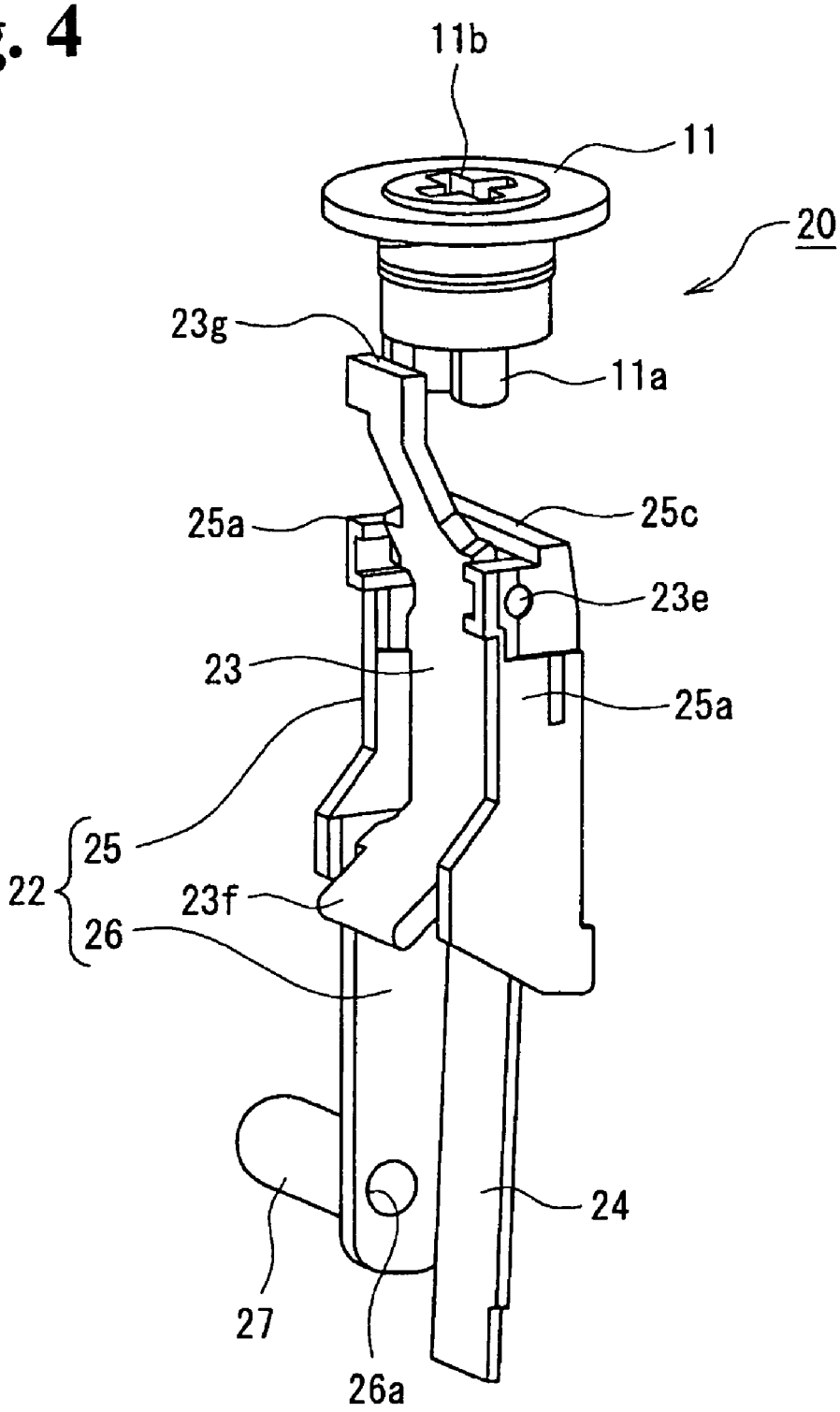
FIG. 4 is a perspective view of the adjusting mechanism in contact with an adjusting dial.
Figure 5:
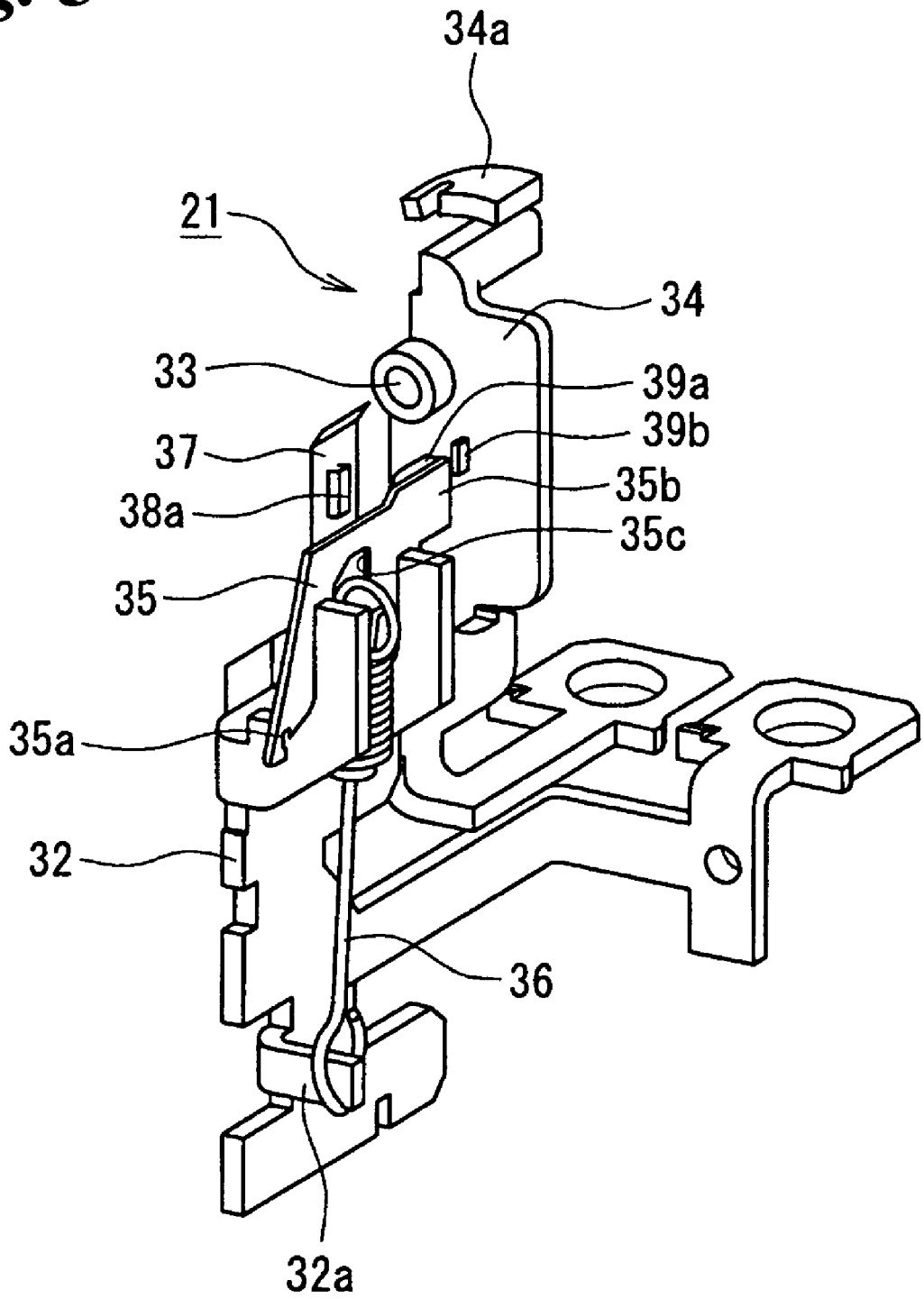
FIG. 5 is a perspective view of a contact reversing mechanism of the thermal overload relay.
Figure 6A:
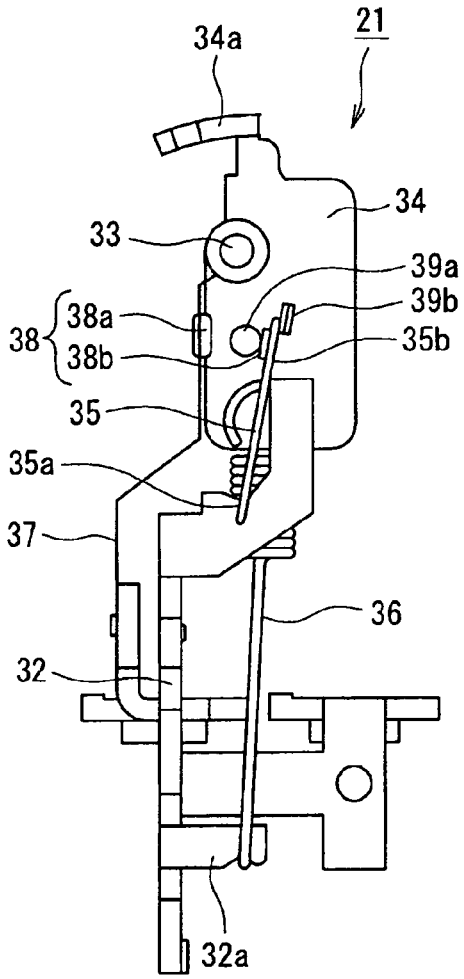
FIG. 6(*a*) is a drawing showing the contact reversing mechanism and a normally open contact (a-contact) that are in an initial state.
Figure 6B:
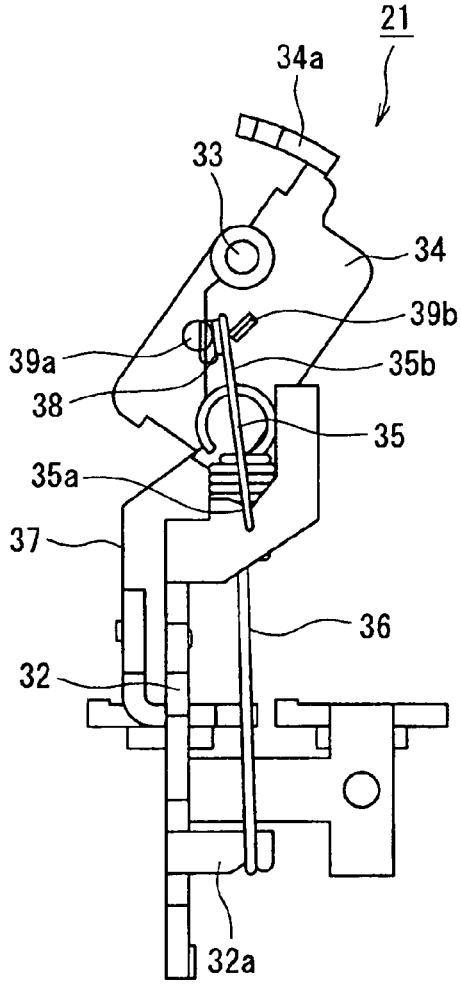
Figure 7A:
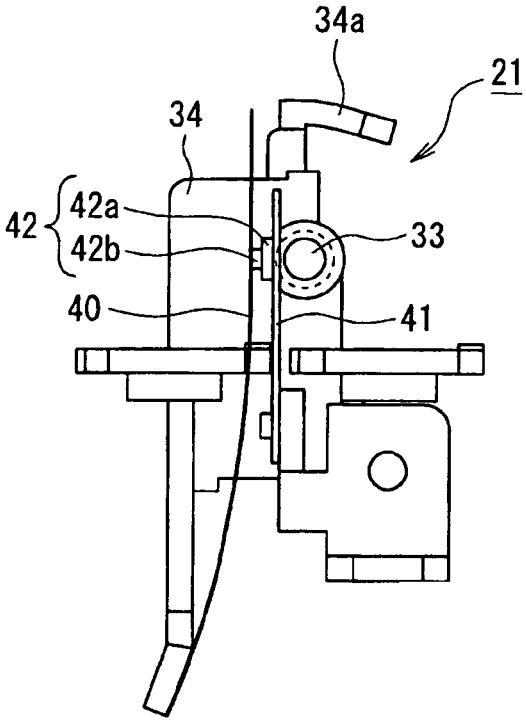
FIG. 7(*a*) is a drawing showing the contact reversing mechanism and a normally closed contact (b-contact) that are in an initial state.
Figure 7B:
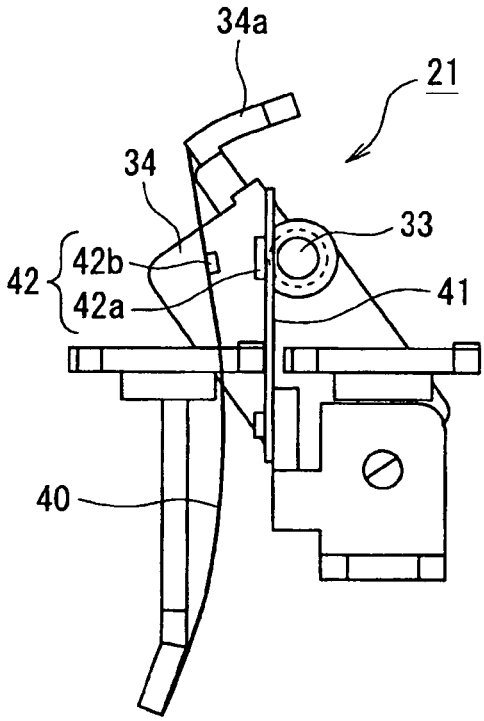
Figure 8:
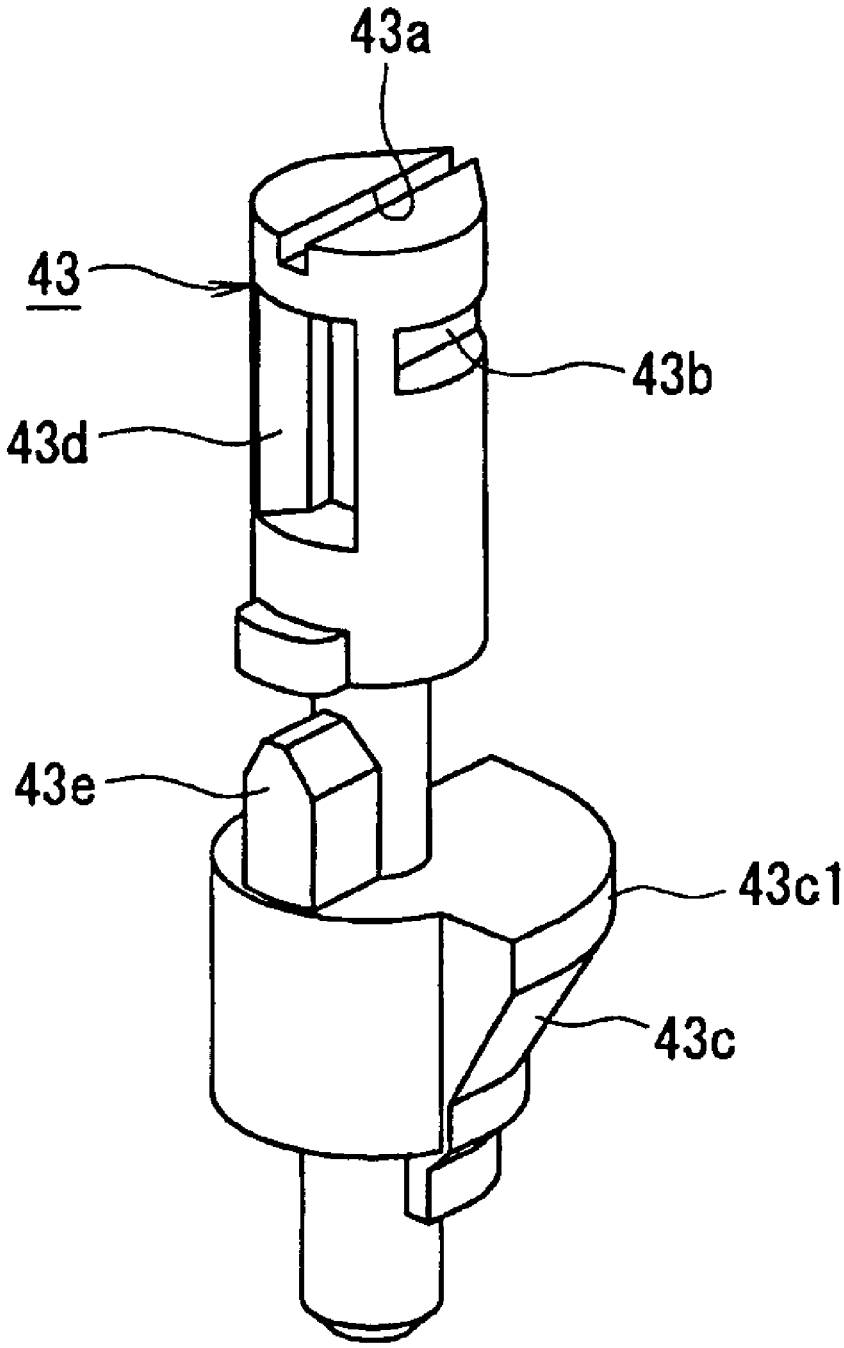
FIG. 8 is a perspective view of a reset bar.
Figure 9A:
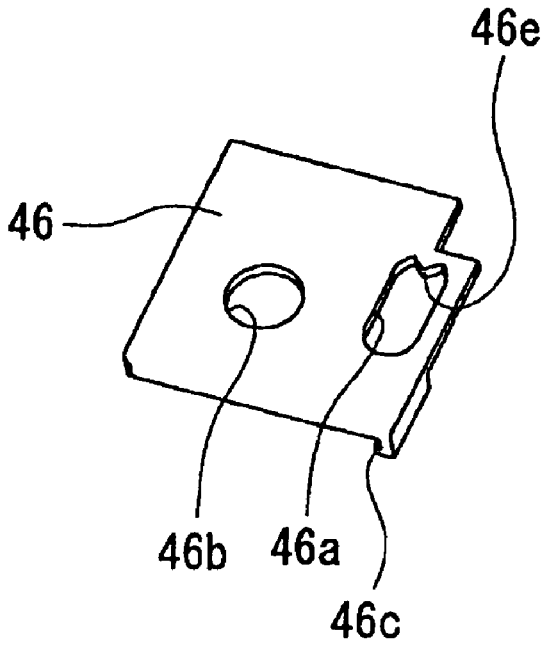
FIGS. 9(*a*) and 9(*b*) are perspective views showing the front side and back side, respectively, of a cover that is slidably coupled to a case of the thermal overload relay.
Figure 9B:
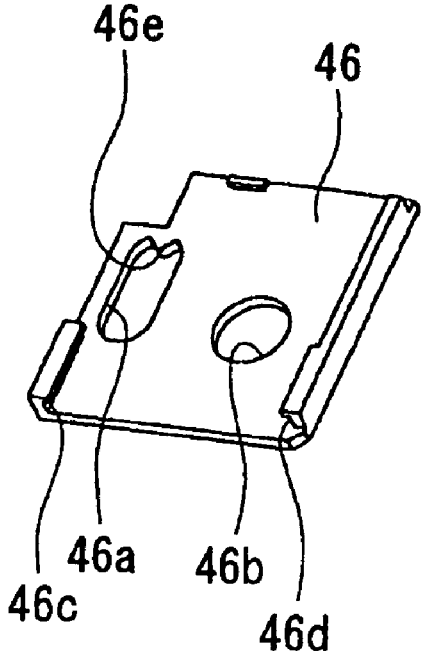
Figure 10:
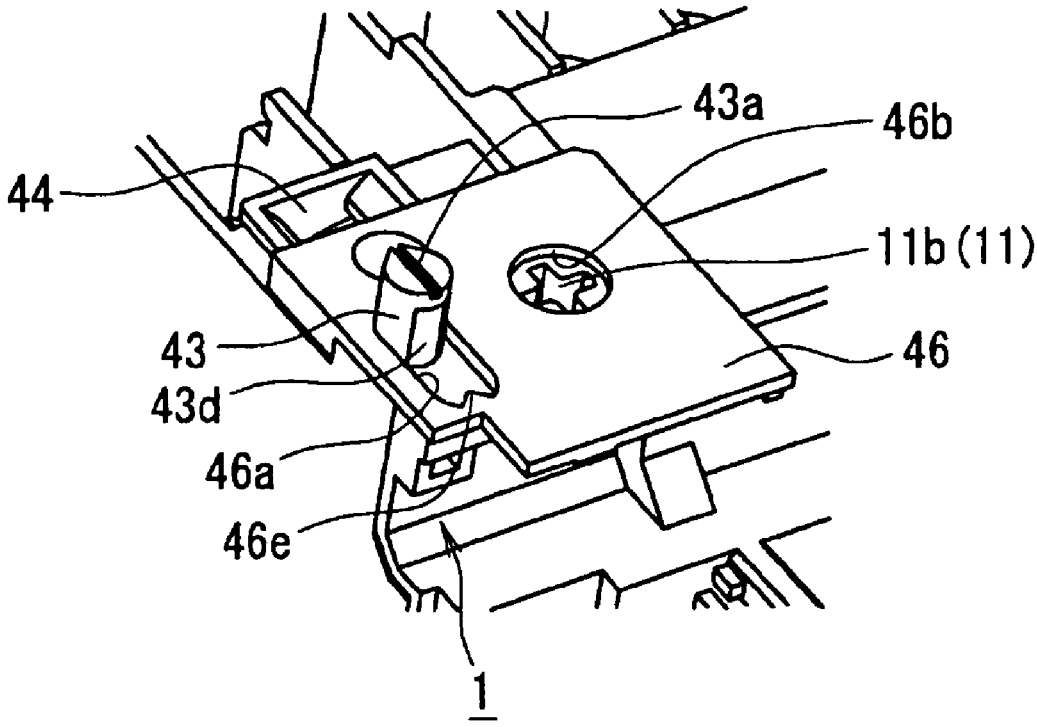
FIG. 10 is a perspective view showing the cover in a position that allows manipulation of the adjusting dial for adjusting the set current and manipulation for manual trip.
Figure 11:
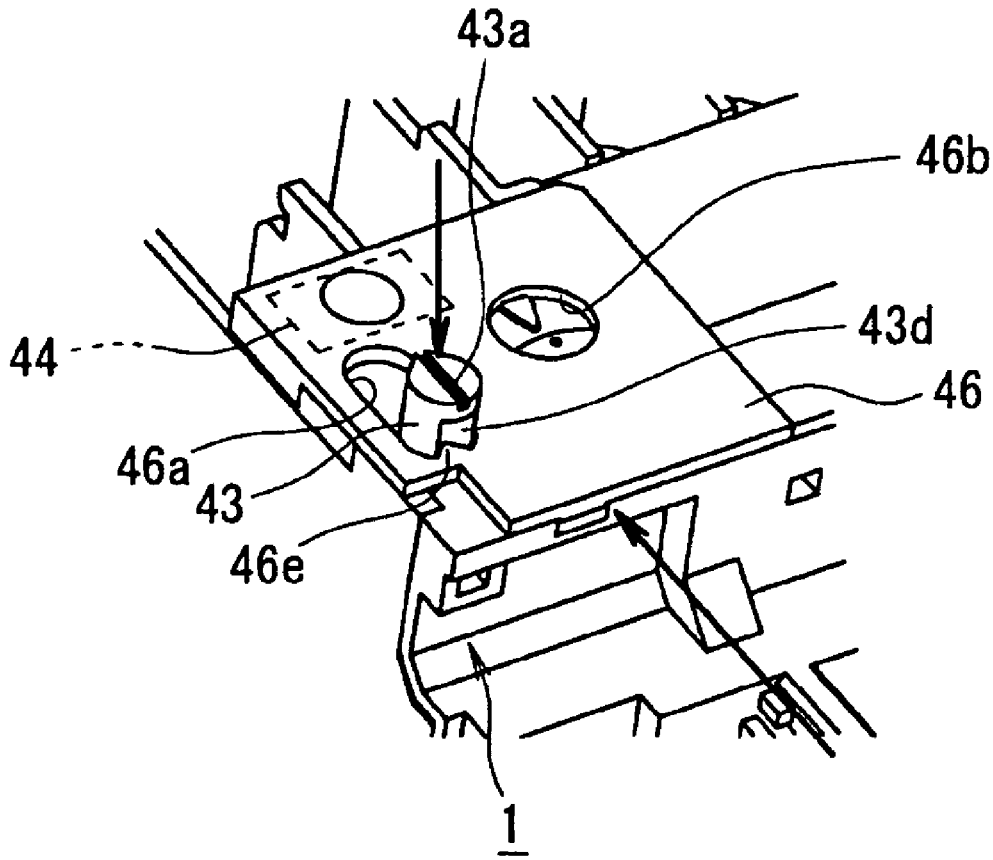
FIG. 11 is a perspective view showing the reset bar in a manual reset state.
Figure 12:
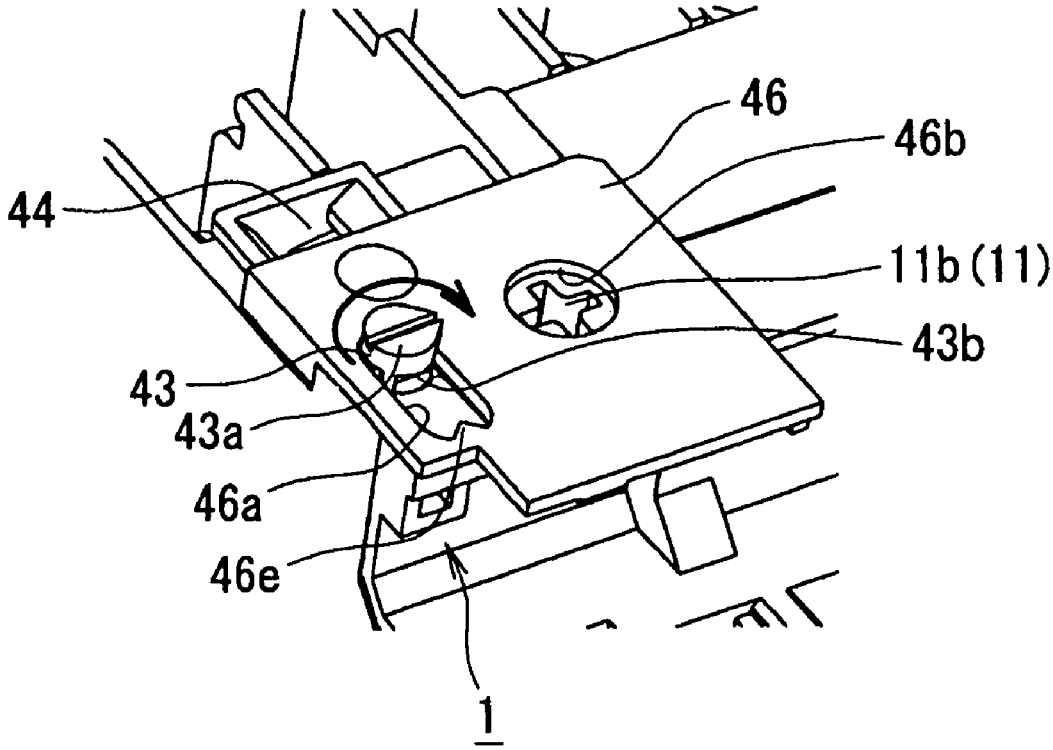
FIG. 12 is a perspective view showing the reset bar in a process to change into an automatic reset state.
Figure 13:
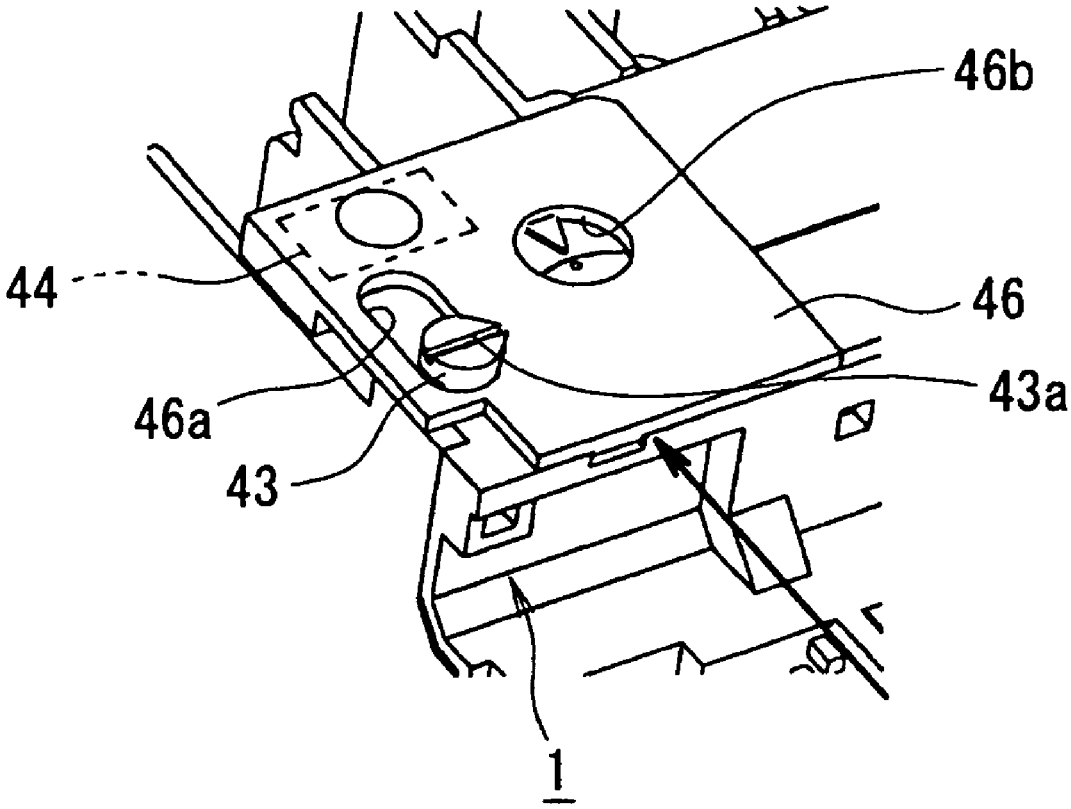
FIG. 13 is a perspective view showing the reset bar in an automatic reset state.

FIGS. 1 through 13 show an embodiment example of a thermal overload relay according to the invention. FIG. 1 is an external view of a thermal overload relay according to the present invention; FIG. 2 is a sectional view of an internal structure of the thermal overload relay of FIG. 1 cut along the line 2-2 in FIG. 1; FIG. 3 is an exploded perspective view of an adjusting mechanism of the thermal overload relay; FIG. 4 is an perspective view of the adjusting mechanism in contact with an adjusting dial; FIG. 5 is a perspective view of a contact reversing mechanism of the thermal overload relay; FIG. 6(*a*) is a drawing showing the contact reversing mechanism and a normally open contact (a-contact) that are in an initial state; FIG. 6(*b*) is a drawing showing the contact reversing mechanism and a normally open contact (a-contact) that are in a tripped state; FIG. 7(*a*) is a drawing showing the contact reversing mechanism and a normally closed contact (b-contact) that are in an initial state; FIG. 7(*b*) is a drawing showing the contact reversing mechanism and a normally closed contact (b-contact) that are in a tripped state; FIG. 8 is a perspective view of a reset bar; FIGS. 9(*a*) and 9(*b*) are perspective views showing the front side and back side, respectively, of a cover that is slidably coupled to a case of the thermal overload relay; FIG. 10 is a perspective view showing the cover in a position that allows manipulation of the adjusting dial for adjusting the set current and manipulation for manual trip: FIG. 11 is a perspective view showing the reset bar in a manual reset state; FIG. 12 is a perspective view showing the reset bar in a process to change into an automatic reset state; and FIG. 13 is a perspective view showing the reset bar in an automatic reset state.

A thermal overload relay of the embodiment as shown in FIG. 1 comprises a manipulation structure 45 at the top of an insulator case 1, the manipulation structure 45 being composed of an adjusting part 11*b* of an adjusting dial 11, a reset bar 43 for reset operation of a contact reversing mechanism, which will be described afterwards, and a window 44 for state-indication and manual trip operation for a contact reversing mechanism. The thermal overload relay also comprises a slide cover 46 attached on the top of the insulator case 1, the slide cover 46 being slid according to an operation of the manipulation structure 45.

In the insulator case 1, disposed are, as shown in FIG. 2, an adjusting mechanism 20 that works according to a displacement of a shifter 3 linked to free end of main bimetals 2 and a contact reversing mechanism 21 that changes-over contacts by an action of the adjusting mechanism 20.

The adjusting mechanism 20 comprises an adjusting link 22, a release lever 23 rotatably supported by the adjusting link 22, and a temperature compensation bimetal 24 fixed to the release lever 23 and linked to the shifter 3.

The adjusting link 22 is composed, as shown in FIG. 3, of a link support 25 supporting the release lever 23 and a leg part 26 extending downwards from one side of the link support 25.

The link support 25, including a pair of bearing holes 25*a*1 formed in the upper portion thereof, has a pair of opposing plates 25*a* opposing each other and a connection plate 25*c* connecting the pair of opposing plates 25*a* and forming an opening 25*b*. The leg part 26 extends downwards from one of the pair of opposing plates 25*a* and includes a bearing hole 26*a* in the lower portion thereof.

A support shaft 27 is provided to protrude from the inner wall at the lower part of the insulator case 1 into an inside of the insulator case 1 as shown in FIG. 2. A tip of the support shaft 27 having a reduced diameter is inserted into the bearing hole 26*a* of the leg part 26 and the whole adjusting link 22 is supported rotatably around the support shaft 27 in the insulator case 1.

The release lever 23 has, as shown in FIG. 3, a base plate 23*a*, a pair of bent plates 23*b*, 23*c* bent from the both ends of the base plate 23*a* towards the same direction with an approximately equal angle. At the side of the bent plate 23*c*, a pair of rotating shafts (release lever supporting parts) 23*d*, 23*e* is formed to be inserted into the pair of bearing holes 25*a*1 of the adjusting link 22. A reversing spring-pushing part 23*f* is formed at the lower end of the bent plate 23*b*, and a cam contacting part 23*g* is formed at the upper end of the bent plate 23*c*, the reversing spring-pushing part 23*f* and the cam contacting part 23*g* positioning at the opposite side with respect to the pair of rotating shafts 23*d*, 23*e*. A caulking or press-fitting part 31 is formed for fixing an end of the temperature compensation bimetal 24 by caulking or press-fitting the rear surface of the base plate 23*a*, the rear surface being in the side opposite to the direction of bending of the bent plates 23*b*, and 23*c*.

The contact reversing mechanism 21 is disposed in the insulator case 1 and comprises, as shown in FIG. 5 and FIG. 6(*a*), a reversing mechanism support 32, an interlock plate 34 disposed in the vicinity of the reversing mechanism support 32 and rotatably supported on a support shaft 33 formed on the inner wall of the insulator case 1, a movable plate 35 with the upper portion 35*b* thereof disposed swingably around the lower portion 35*a* of the movable plate 35 abutting on the reversing mechanism support 32, and a reversing spring 36 that is a tension coil spring stretching between an engaging hole 35*c* formed in the side of the upper portion 35*b* of the movable plate 35 and a spring support 32*a* of the reversing mechanism support 32 positioned at a place lower than the lower part 35*a* of the movable plate 35.

The interlock plate 34 has, as shown in FIG. 5 and FIG. 6(*a*), a first linking pin 39*a* and a second linking pin 39*b* capable of linking to the movable plate 35, the first and second linking pins 39*a* and 39*b* making the interlock plate 34 to rotate around the support shaft 33 in the reversing operation and the returning operation of the movable plate 35. A leaf spring 37 of the normally open contact (a-contact) side is fixed on the reversing mechanism support 32 in the configuration with the free end of the leaf spring 37 extending upwards. A fixed contact piece 38*a* of the a-contact 38 is fixed on the free end side of the leaf spring 37. A movable contact piece 38*b*, which is made to contact with the fixed contact piece 38*a*, of the a-contact 38 is fixed on the upper portion 35*b* of the movable plate 35.

In the opposite side to the a-contact 38 with respect to the interlock plate 34, as shown in FIG. 7(*a*), a leaf spring 40 of the normally closed contact (b-contact) side is disposed in the configuration with the free end of the leaf spring 40 extending upwards. A contact support plate 41 is disposed opposing the leaf spring 40. The free end of the leaf spring 40 links to a part of the interlock plate 34 and rotates simultaneously with the rotation of the interlock plate 34 in the same direction. A movable contact piece 42*b* of the b-contact 42 is fixed on the free end side of the leaf spring 40; and a fixed contact piece 42*a*, which is made to contact with the movable contact piece 42*b*, of the b-contact 42 is fixed to the contact support plate 41.

The reset bar 43, as shown in FIG. 8, has a groove 43*a* formed on the top surface of the head of the reset bar 43 for inserting a tip of a tool such as a flathead screw driver to turn the reset bar 43. The reset bar 43 further has a locking slot 43*b* formed on the circumferential surface near the top of the reset bar 43 for coupling to the slide cover 46 (described afterwards with reference to FIG. 10). The reset bar 43 further has a guiding slot 43*d* with a configuration elongated in the axial direction formed at a position circumferentially apart from the locking slot 43*b* by an angle of about 90 degrees for coupling to the slide cover 46 (described afterwards with reference to FIG. 12). The reset bar 43 still further has a reset block 43*c* with a radius gradually increasing towards the top direction formed on the circumferential surface at the lower side (near the end axially opposite to the head) in the circumferential range of an angle of about 90 degrees. A projection 43*e* is formed in the neck portion between the head and the reset block 43*c* at the same circumferential position as the guiding slot 43*d*.

The reset bar 43, as shown in FIG. 2, is disposed with the axis thereof in the vertical direction at the upper place in the insulator case 1. The reset bar 43 is forced upwards by a return spring (not shown in the figures) of a compression spring attached around the bottom portion of the reset bar, and the head of the reset bar is projecting out of the top surface of the insulator case 1. The projection 43*e* of the reset bar 43 is disposed as shown in FIG. 2 intervening between rotation obstruction blocks la, lb provided in the insulator case 1 and obstructs rotation of the reset bar 43 that is at the position with the whole head thereof protruding out of the top surface of the insulator case 1, due to abutting of the projection 43*e* against the rotation obstruction blocks la, lb. When the reset bar 43 is pushed-in as shown by the dotted line in FIG. 2 so that almost whole head positions within the insulator case 1, the rotation obstruction blocks la, lb are absent at the sides of the projection 43 shifted downwards, allowing the reset bar 43 to rotate. At this time, the reset block 43*c* of the reset bar 43 comes to contact with the a-contact side leaf spring 37 shown in FIG. 6(*b*), thereby returning the movable plate 35 from the tripped state to the initial position (in the normal state).

Now referring to FIG. 5, the interlock plate 34 has a trip operation beam 34*a* formed at the top thereof. The trip operation beam 34*a* in the initial state of the interlock plate 34 can be observed through the window for state-indication and manual trip operation 44 opened in the top surface of the insulator case 1 (see FIG. 1). From this state, the movable plate 35 can be rotated via the interlock plate 34 in the direction for turning to the tripped state by manipulating the trip operation beam 34*a* using a tool such as a screw driver inserted through the window for state-indication and manual trip operation 44.

The slide cover 46 is slid corresponding to the manipulation of the manipulation structure 45 composed of the adjusting part 11*b* of the adjusting dial 11, the reset bar 43 and the window for state-indication and manual trip operation 44. The slide cover 46 is made of a transparent resin. In the slide cover 46, a reset bar passing window 46*a* and an adjusting dial operation window 46*b* are formed as shown in FIGS. 9(*a*) and 9(*b*). The slide cover 46 has slide guides 46*c*, 46*d* to slidably couple to rails (not illustrated) provided on the top of the insulator case 1.

The reset bar passing window 46*a* has a configuration elongated in the direction as same as direction of extension of the slide guides 46*c*, 46*d*, and has a reset bar locking projection 46*e* formed at one longitudinal end of the periphery of the window.

Now operation of the embodiment of the thermal overload relay will be described in the following.

At first, description of the operation of the thermal overload relay is made in the case of the reset bar 43 in the manual reset state.

Referring to FIG. 10, the slide cover 46 is positioned so that the reset bar 43 projects out of the reset bar passing window 46*a* at the longitudinal end of the window farthest from the reset bar coupling protrusion 46*e*. Here, the reset bar 43 is set at the angular position so that the guiding slot 43*d* faces the reset bar coupling protrusion 46*e*.

In this configuration, the adjusting dial operation window 46*b* of the slide cover 46 just corresponds to the adjusting part 11*b* of the adjusting dial 11. Consequently, the adjusting part 11*b* of the adjusting dial 11 can be rotated by using a tool such as a screw driver inserted through the adjusting dial operation window 46*b* to change the rotation angle of the release lever 23, thereby adjusting a setting current.

Since the slide cover 46 is not covering the window for state-indication and manual trip operation, the thermal overload relay can be tentatively turned to the manually tripped state by manipulation on the trip operation beam 34*a* using a tool such as a screw driver inserted through the window for state-indication and manual trip operation 44. In this changing process, the tool is coupled to the trip operation bean 34*a* and the interlock plate 34 in the initial state as shown in FIG. 6(*a*) is turned clockwise around the support shaft 33. With the rotation of the interlock plate 34, the second linking pin 39*b* linking to the movable plate 35 turns the movable plate 35 in the direction to change to the tripped state, resulting in connection between the fixed contact piece 38*a* and the movable contact piece 38*b* of the a-contact 38. The interlock plate 34 in the initial state illustrated in FIG. 7(*a*) on the other hand, is turned counterclockwise around the support shaft 33, separating the fixed contact piece 42*a* and the movable contact piece 42*b* of the b-contact 42 from each other.

Then, as shown in FIG. 11, the slide cover 46 is slid so that the longitudinal end of the reset bar passing window 46*a* at which the reset bar coupling protrusion 46*e* is formed approaches the reset bar 43. As a result, the reset bar coupling protrusion 46*e* couples to the guiding slot 34*d* of the reset bar 43. Thus, the reset bar 34 becomes to the manual reset state.

After the slide cover 46 is slid until the reset bar coupling protrusion 46*e* couples to the guiding slot 43*d* to change the reset bar 43 to the manual reset state, the adjusting dial operation window 46*b* comes out of the correspondence to the adjusting part lib of the adjusting dial 11 and the window for state-indication and manual trip operation 44 is covered by the slide cover 46. In this manual reset state, thus, adjustment of setting current by the adjusting dial 11 and manipulation to the manual trip cannot be conducted.

When an overcurrent flows in the thermal overload relay of this embodiment, the main bimetal 2 is bent with the heat generated in the heater 2*a* by the overcurrent. Displacement of the free end of the main bimetal 2 displaces the sifter 3 in the direction of arrow Q indicated in FIG. 2. When the free end of the temperature compensation bimetal 24 is pushed by the displaced sifter 3, the release lever 23 joined to the temperature compensation bimetal 24 rotates clockwise around the rotating shafts 23*d*, 23*e* supported by the adjusting link 22 and the reversing spring pushing part 23*f* of the release lever 23 pushes the reversing spring 36.

In progression of clockwise rotation of the release lever 23, at the moment the pushing force of the reversing spring pushing part 23*f* exceeds the spring force of the reversing spring 36, the movable plate 35 starts to perform a reversing action around the lower part 35*a*. Accompanying the reversing action of the movable plate 35, the interlock plate 34, receiving the reversing action of the movable plate 35 transmitted through the first linking pin 39*a*, rotates around the support shaft 33 (see FIG. 6(*b*) and FIG. 7(*b*)).

As a result, the fixed contact piece 38*a* and the movable contact piece 38*b* of the a-contact 38 in the open state shown in FIG. 6(*a*) are connected together, and the fixed contact piece 42*a* and the movable contact piece 42*b* of the b-contact 42 in the closed state as shown in FIG. 7(*a*) are separated away. Based on the information of the a-contact 38 and the b-contact 42, the electromagnetic contactor (not illustrated) is opened to interrupt the overcurrent in the main circuit.

Then, in the condition of the main bimetal 2 returned to the original configuration from the bent state after interruption of the main circuit current, the reset bar 43 in the manual reset state is pushed-in downwards as indicated by the arrow in FIG. 11. In this process, the reset bar 43 is smoothly pushed-in because the guiding slot 43*d* is coupled to and guided by the reset bar coupling protrusion 46*e* at the reset bar passing window 46*a*.

With this manual reset operation of the reset bar 43, the reset block 43*c* exerts a resetting force through the a-contact side leaf spring 37 on the movable plate 35 in the tripped state shown in FIG. 6(*b*), thereby returning the movable plate 35 to the position of the initial state and at the same time, returning the interlock plate 34 to the position of the initial state (normal state) through the second linking pin 39*b*. Thus, the thermal overload relay is reset.

In order to change the reset bar 43 in the manual reset state to the automatic reset state on the other hand, referring to FIG. 12, a tip of a tool such as a flat head screw driver is inserted to the groove 43*a* of the reset bar 43 to push-in the reset bar 43. After this manipulation, the rotation obstruction blocks 1*a*, 1*b* are absent in both sides of the protrusion 43*e* formed on the reset bar 43 (see FIG. 2), allowing rotation of the reset bar 43. The reset bar 43 is rotated clockwise by about 90 degrees to face between the locking slot 43*b* and the reset bar coupling projection 46*e* at the reset bar passing window 46*a*.

Then, as shown in FIG. 13, the slide cover 46 is slid so that the reset bar coupling projection 46*e* at the reset bar passing window 46*a* is coupled to the locking slot 43*b* of the reset bar 43. As a consequence, the reset bar 43 is held in the pushed-in state with the top of the head of the reset bar 43 projecting out from the slide cover 46. Thus, the reset bar 43 is set in the automatic reset state.

In the circumstance the slide cover 46 has been moved so that the reset bar 43 becomes in the automatic reset state, the adjusting dial operation window 46*b* does not position at a place corresponding to the adjusting part 11*b* of the adjusting dial 11, and the window for state-indication and manual trip operation 44 is covered by the slide cover 46. Consequently, in the automatic reset state, too, like in the manual reset state, adjustment of a setting current by the adjusting dial 11 and manipulation for manual trip are obstructed.

When an overcurrent flows in this condition, bend of the main bimetal 2 is transmitted through the shifter 3 and the temperature compensation bimetal 24 causing rotation of the release lever 23, which in turn pushes the reversing spring 36 via the reversing spring pushing part 23*f*. Reversing action of the reversing spring 36 is obstructed by the .first liking pin 39*a* of the interlock plate 34, on which the larger radius portion 43*c*1 of the reset block 43*c* is abutting. As a consequence, the a-contact 38 and the b-contact 42 comes to a state where the distance between the fixed contact piece 38*a* and the movable contact piece 38*b* of the a-contact 38 is small and the distance between the fixed contact piece 42*a* and the movable contact piece 42*b* of the b-contact 42 is small.

In the condition the reset bar 43 has been changed to the automatic reset state, the reversing operation of the reversing spring 36 does not complete even due to an overcurrent, and after cooling down of the main bimetal 2, the reversing spring 36 automatically returns to the initial state.

Now, effects of the present invention will be described in the following.

When the reset bar 43 is in the manual reset state, the reset bar 43 is projected out of the reset bar passing window 46*a* formed with an elongated hollow shape in the slide cover 46 at the position furthest from the reset bar coupling projection 46*e*. When the reset bar 43 is changed to the automatic reset state, the reset bar 43 is pushed-in and turned so that the locking slot 43*b* formed on the circumferential surface of the reset bar 43 faces the reset bar coupling projection 46*e* on the peripheral surface of the reset bar passing window 46*a* at the one longitudinal end. Then, the slide cover 46 is slid so that the coupling between the locking slot 43*b* and the reset bar coupling projection 46*e* is established. In this state, the reset bar 43 is held in the pushed-in condition. Therefore, the reset bar 43 is manipulated simply to change from the manual reset state to the automatic reset state.

The manipulation for changing-over between the manual reset state and the automatic reset state of the reset bar 43 can be conducted at any desired time only sliding the slide cover 46. A condition, whether the reset bar 43 is pushed-in and held or the reset bar 43 is not pushed-in, can be confirmed. Therefore, wrong operation can be obviated between the manual reset state and the automatic reset state.

In the process of pushing-in of the reset bar 43 in the manual reset state, the reset bar 43 is guided by the reset bar coupling projection 46*e* on the reset bar passing window 46*a* coupled to the guiding slot 43*d* of the reset bar 43. Therefore, the pushing-in action of the reset bar 43 is performed smoothly.

When the reset bar 43 is changed to the automatic reset state, the slide cover 46 covers the adjusting part 11*b* of the adjusting dial 11 and the window 44 for state-indication and manual trip operation, inhibiting adjusting action of a setting current by the adjusting dial 11 and manipulation for manual trip. Therefore, wrong operation is obviated in the thermal overload relay.

In addition, the slide cover 46 is made of a transparent material. Consequently, the adjustment value of the adjusting part lib can be checked even if the adjusting part lib of the adjusting dial 11 is covered with the slide cover, and the operating state of the contact reversing mechanism 21 (specifically interlock plate 34) at that time can be confirmed even when the window 44 for state-indication and manual trip operation is covered with the slide cover.

The disclosure of Japanese Patent Application No. 2009-0793.92 filed on Mar. 27, 2009 is incorporated as a reference.

While the invention has been explained with reference to the specific embodiments of the invention, the explanation is illustrative and the invention is limited only by the appended claims.

What is claimed is:

1. A thermal overload relay comprising:

a main bimetal displaced by bending deformation upon detection of an overload current;

a shifter cooperating with operation of the main bimetal;

a release lever working according to a displacement of the shifter that displaces following a displacement of the main bimetal;

a contact reversing mechanism for changing-over contacts by reversing action caused by rotation of the release lever;

a case for retaining the main bimetal, release lever, and contact reversing mechanism;

a manipulation structure held in the case for manipulating the release lever and the contact reversing mechanism, the manipulation structure including a reset bar for returning the contact reversing mechanism to an initial state, the reset bar partially protruding out of the case and being arranged to change-over between a manual reset state in which the reset bar can be pushed-in and an automatic reset state in which the reset bar is pushed-in and turned from the manual reset state and held in that state; and a cover slidably attached on the case to be able to cover the manipulation structure, the cover including an elongated reset bar passing window to pass a head of the reset bar with a longitudinal direction being in a sliding direction of the cover, and a locking projection formed at one longitudinal end on a periphery of the reset bar passing window, wherein the reset bar is positioned at one longitudinal end of the reset bar passing window by sliding the cover towards a direction to cover the manipulation structure in the manual reset state and the automatic reset state; and the reset bar includes a bar locking slot on an outer circumferential surface thereof, and is held in a pushed-in state by coupling the bar locking slot and the locking projection formed at one end of the reset bar passing window in the automatic reset state.

2. The thermal overload relay according to claim 1, wherein the reset bar includes a guiding slot on the circumferential surface thereof at a circumferential position different from a position of the locking slot, the guiding slot of the reset bar couples to the locking projection of the reset bar passing window in the manual reset state, and the reset bar is pushed-in with guidance by the guiding slot and the locking projection.

3. The thermal overload relay according to claim 1, wherein the manipulation structure comprises an adjusting dial to couple to the release lever for adjusting a setting current, the cover includes a dial window having a size corresponding to an adjusting part of the adjusting dial, the dial window faces the adjusting part of the adjusting dial when the reset bar is slid to the other longitudinal end of the reset bar passing window, and the adjusting part of the adjusting dial is covered by a slid cover in the manual reset state and the automatic reset state.

4. The thermal overload relay according to claim 1, further comprising a window for a state-indication and manual trip operation, in a vicinity of the reset bar, for manually reversing the contact reversing mechanism and confirming an operational state of the contact reversing mechanism, wherein the window for the state-indication and manual trip operation is not covered by the cover in a condition of the reset bar slid to the other longitudinal end of the reset bar passing window that is farthest from a coupling projection of the cover, and the window for state-indication and manual trip operation is covered by the cover in the manual reset state and the automatic reset state.

5. The thermal overload relay according to claim 1, wherein the cover is formed of a transparent material.

* * * * *

UNITED STATES PATENT AND TRADEMARK OFFICE

CERTIFICATE OF CORRECTION

PATENT NO. : 8,188,831 B2
APPLICATION NO. : 12/656731
DATED : May 29, 2012
INVENTOR(S) : Fumihiro Morishita et al.

It is certified that error appears in the above-identified patent and that said Letters Patent is hereby corrected as shown below:

Change column 10, line 6, “by the .first liking pin” to --by the first liking pin--.

Change column 10, line 60, “pair lib can be checked even if the adjusting part lib of the” to --pair 11b can be checked even if the adjusting part 11b of the--.

Change column 10, line 67, “0793.92 filed on” to --079392 filed on--.

Signed and Sealed this
Twenty-fifth Day of September, 2012

David J. Kappos

David J. Kappos
*Director of the United States Patent and Trademark Office*